US006862810B2

(12) United States Patent
Braun et al.

(10) Patent No.: US 6,862,810 B2
(45) Date of Patent: Mar. 8, 2005

(54) HAIR-TRIMMER WITH RELEASABLE CUTTING HEAD

(75) Inventors: Christopher J. Braun, Racine, WI (US); Mark A. Pleshek, Milwaukee, WI (US)

(73) Assignee: Andis Company, Sturtevant, WI (US)

( * ) Notice: Subject to any disclaimer, the term of this patent is extended or adjusted under 35 U.S.C. 154(b) by 71 days.

(21) Appl. No.: 10/464,204

(22) Filed: Jun. 18, 2003

(65) Prior Publication Data

US 2003/0233755 A1 Dec. 25, 2003

Related U.S. Application Data

(60) Provisional application No. 60/390,553, filed on Jun. 21, 2002.

(51) Int. Cl.[7] ..... B26B 19/06
(52) U.S. Cl. ..... 30/210
(58) Field of Search ..... 30/210, 216, 223, 30/221, 208, 220

(56) References Cited

U.S. PATENT DOCUMENTS

| | | | | |
|---|---|---|---|---|
| 2,182,597 A | | 12/1939 | Oster | |
| 2,703,930 A | | 3/1955 | Bridenbaugh | |
| 3,222,781 A | | 12/1965 | Luther et al. | |
| 3,279,062 A | | 10/1966 | Andis | |
| 3,589,007 A | * | 6/1971 | Walton | 30/140 |
| 3,992,778 A | | 11/1976 | Urbush | |
| 4,249,307 A | | 2/1981 | Andis | |
| 4,328,616 A | | 5/1982 | Andis | |
| 4,557,050 A | | 12/1985 | Haraguchi et al. | |
| 4,581,822 A | * | 4/1986 | Fujimura | 30/216 |
| 4,694,575 A | | 9/1987 | Boerger | |
| 4,765,060 A | | 8/1988 | Veselaski et al. | |
| 4,989,324 A | | 2/1991 | Andis | |
| 5,092,048 A | | 3/1992 | Sukow et al. | |
| 5,230,153 A | | 7/1993 | Andis | |
| 5,325,589 A | | 7/1994 | Kubo | |
| 5,367,772 A | | 11/1994 | Ogawa | |
| 5,386,634 A | | 2/1995 | Ogle et al. | |
| 5,606,799 A | * | 3/1997 | Melton | 30/216 |
| 2004/0049921 A1 | * | 3/2004 | Freas et al. | 30/223 |

FOREIGN PATENT DOCUMENTS

| | | |
|---|---|---|
| DE | 1 218 903 | 6/1966 |
| GB | 11110 | 9/1910 |
| GB | 2 023 051 A | 12/1979 |

* cited by examiner

*Primary Examiner*—Hwei-Siu Payer
(74) *Attorney, Agent, or Firm*—Michael Best & Friedrich LLP

(57) ABSTRACT

A hair trimmer having a clip, a releasable cutting head, and a release button operable to release the cutting head from an operating position to an open position when actuated by an operator of the hair trimmer. The clip selectively retains the cutting head in the operating position and releases the cutting head from the operating position to the open position when the release button is actuated by an operator of the hair trimmer. The clip also biases the release button to a retracted position, the release button being in the retracted position when the cutting head is in the operating position. The clip also holds the top and bottom portions of the hair trimmer body together for operation of the hair trimmer.

20 Claims, 6 Drawing Sheets

HAIR-TRIMMER WITH RELEASABLE CUTTING HEAD

This application claims the benefit of U.S. Provisional application No. 60/390,553 filed on Jun. 21, 2002.

FIELD OF THE INVENTION

The invention relates generally to hair trimmers and to arrangements for selectively releasing and retaining cutting heads of such hair trimmers.

BACKGROUND OF THE INVENTION

A cutting head of a hair trimmer typically includes a blade set having a fixed blade in face-to-face relation with a movable blade. An electric motor is drivingly connected to the movable blade to effect reciprocation thereof in response to actuation of the motor. A number of suitable motors and driving arrangements are known.

Hair trimmer performance can generally be improved by cleaning cut hairs from around the blade set and the driving arrangement and by lubricating the blade set and the driving arrangement. To allow for this, the cutting head is often configured to be movable from an operating position to an open position such that the blade set and the driving arrangement are exposed. Such movement also allows for the performance of other maintenance on the blade set and the driving arrangement.

Although prior art hair trimmers include a number of arrangements for releasing and retaining the cutting head, improvements upon the prior arrangements would be welcomed by those in the art.

SUMMARY OF THE INVENTION

The present invention provides a hair trimmer having a clip, a releasable cutting head, and a release button operable to release the cutting head from an operating position when actuated by an operator of the hair trimmer. The clip selectively retains and releases the cutting head, biases the release button to a retracted position, and/or holds the top and bottom portions of the hair trimmer body together.

The clip includes two sets of forwardly extending portions or prongs and two sets of rearwardly extending portions or prongs. Both sets of forwardly extending prongs function as cantilever springs, a first set biasing the release button to a retracted position, a second set retaining the cutting head in the operating position. To release the cutting head from the operating position, the release button is actuated by sliding the release button along a corresponding surface of the hair trimmer body toward the cutting head. The release button is moved in opposition to the retention force provided by the first set of biasing prongs such that the release button pushes against the cutting head and moves it away from the operating position. Such movement releases the cutting head from the second set of retaining prongs and allows the cutting head to move to the open position.

When the blade set and the driving arrangement are fully exposed, the operator can perform cleaning, lubrication, and/or maintenance as desired. To return the cutting head to the operating position, the cutting head is moved toward the closed position until it snaps into place under the retention force provided by the second set of retaining prongs.

Both sets of rearwardly extending prongs cooperate to hold the cutting end of the top and bottom portions of the hair trimmer body together, a first set functioning as clasps which are secured to the bottom portion of the body, a second set functioning as cantilever springs to secure the top portion of the body to the bottom portion of the body.

Further objects of the present invention, together with the organization and manner of operation thereof, will become apparent from the following detailed description of the invention when taken in conjunction with the accompanying drawings wherein like elements have like numerals throughout the drawings.

BRIEF DESCRIPTION OF THE DRAWINGS

The present invention is further described with reference to the accompanying drawings, which show an embodiment of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention. Also, it is understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," and "coupled" are used broadly and encompass both direct and indirect mountings, connections, and couplings. Further, "connected" and "coupled" are not restricted to physical or mechanical connections or couplings. Additionally, unless specified or limited otherwise, the terms "top," "bottom," "forward," and "rearward" and variations thereof as used herein are not meant to indicate a particular direction, but rather a relative direction with respect to the context of the discussion.

DETAILED DESCRIPTION

Figure 1:
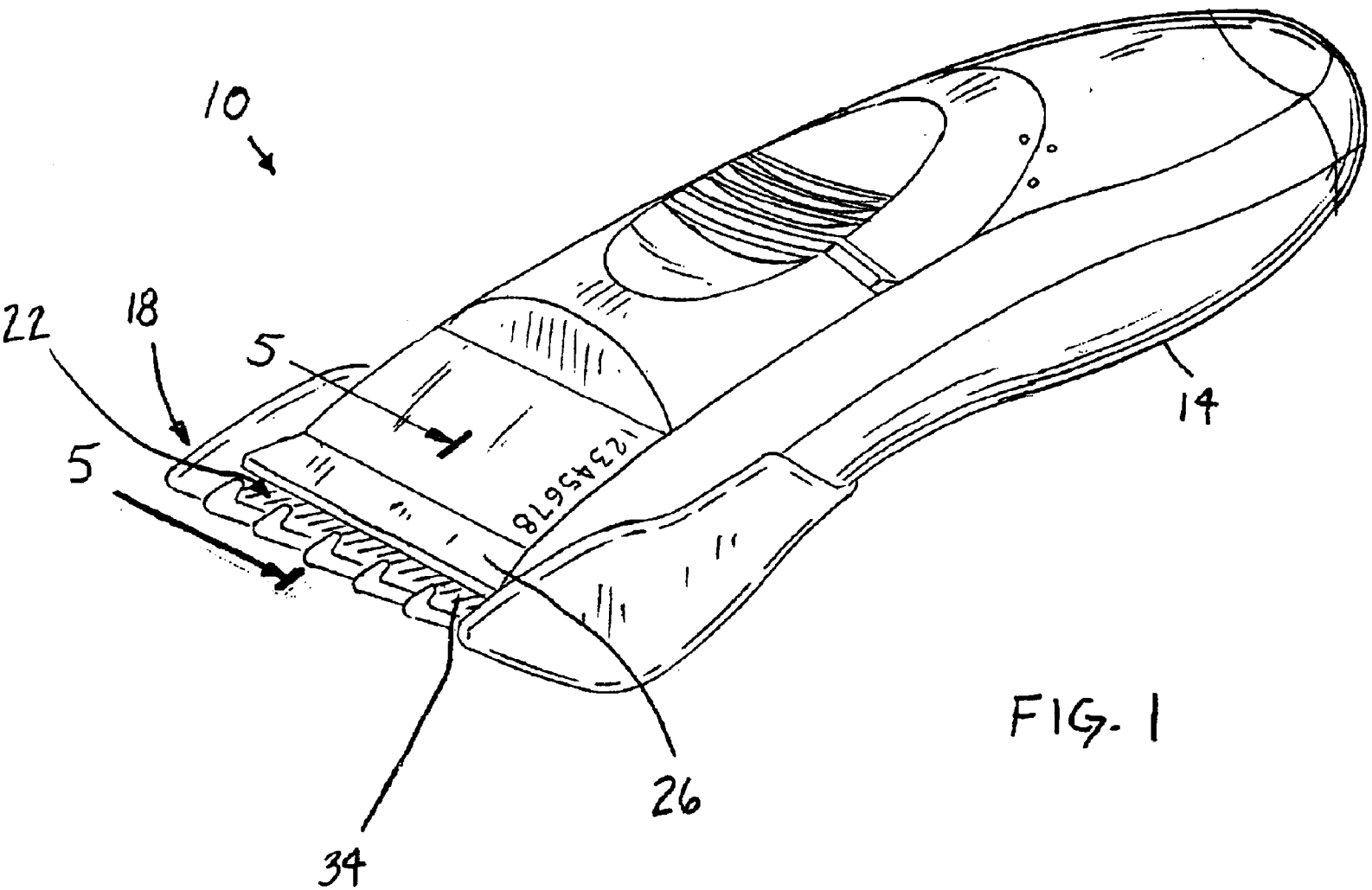
FIG. 1 is a perspective view of a hair trimmer embodying various features of the invention.
Figure 2:
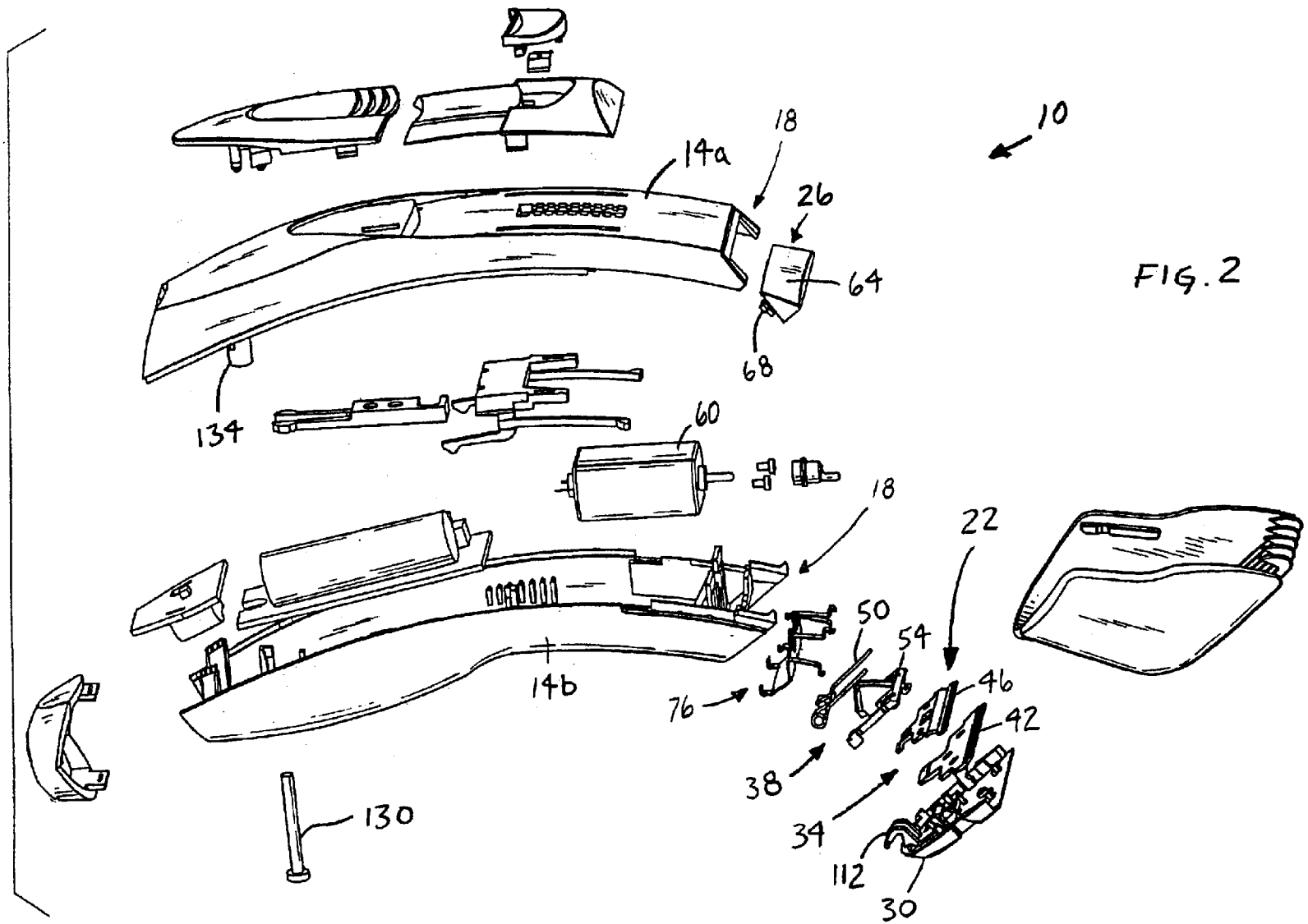
FIG. 2 is an exploded view of the hair trimmer shown in FIG. 1.
Figure 3:
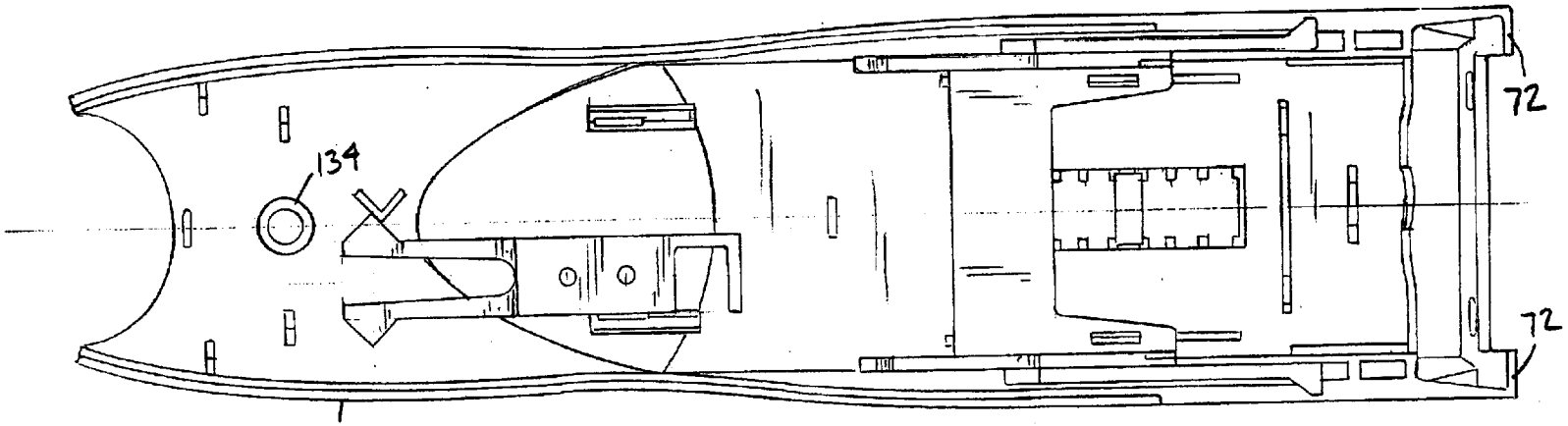
FIG. 3 is a bottom view of a top portion of the hair trimmer shown in FIG. 1.
Figure 4:
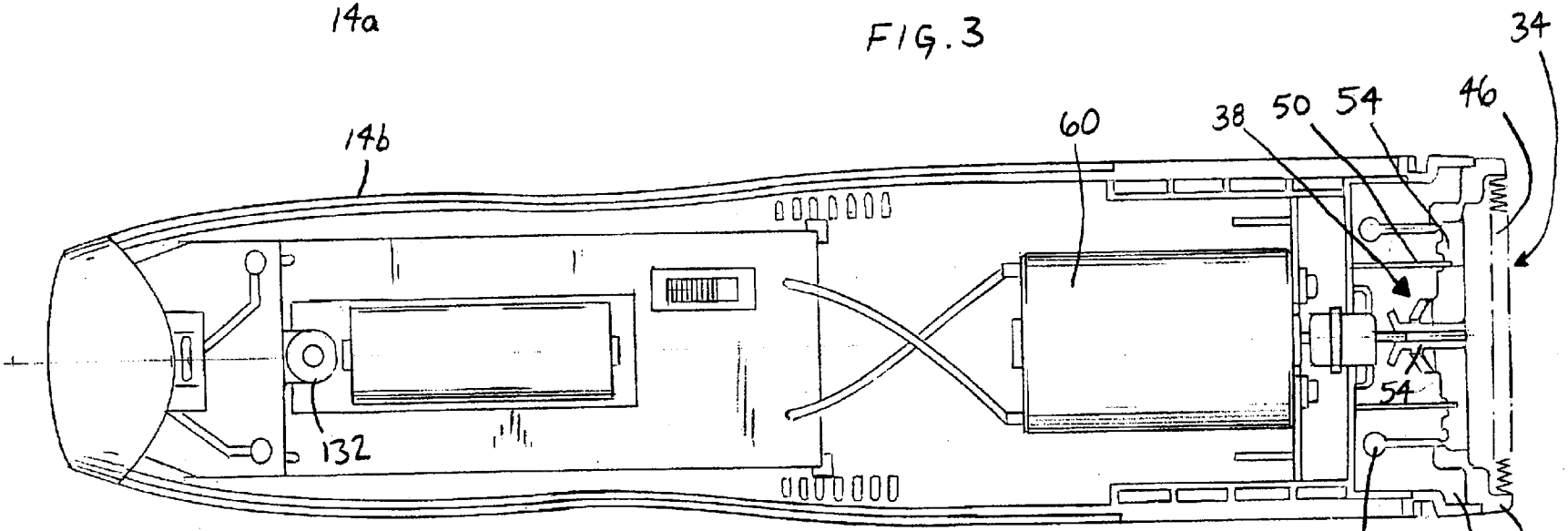
FIG. 4 is a top view of a bottom portion of the hair trimmer shown in FIG. 1.
Figure 7:
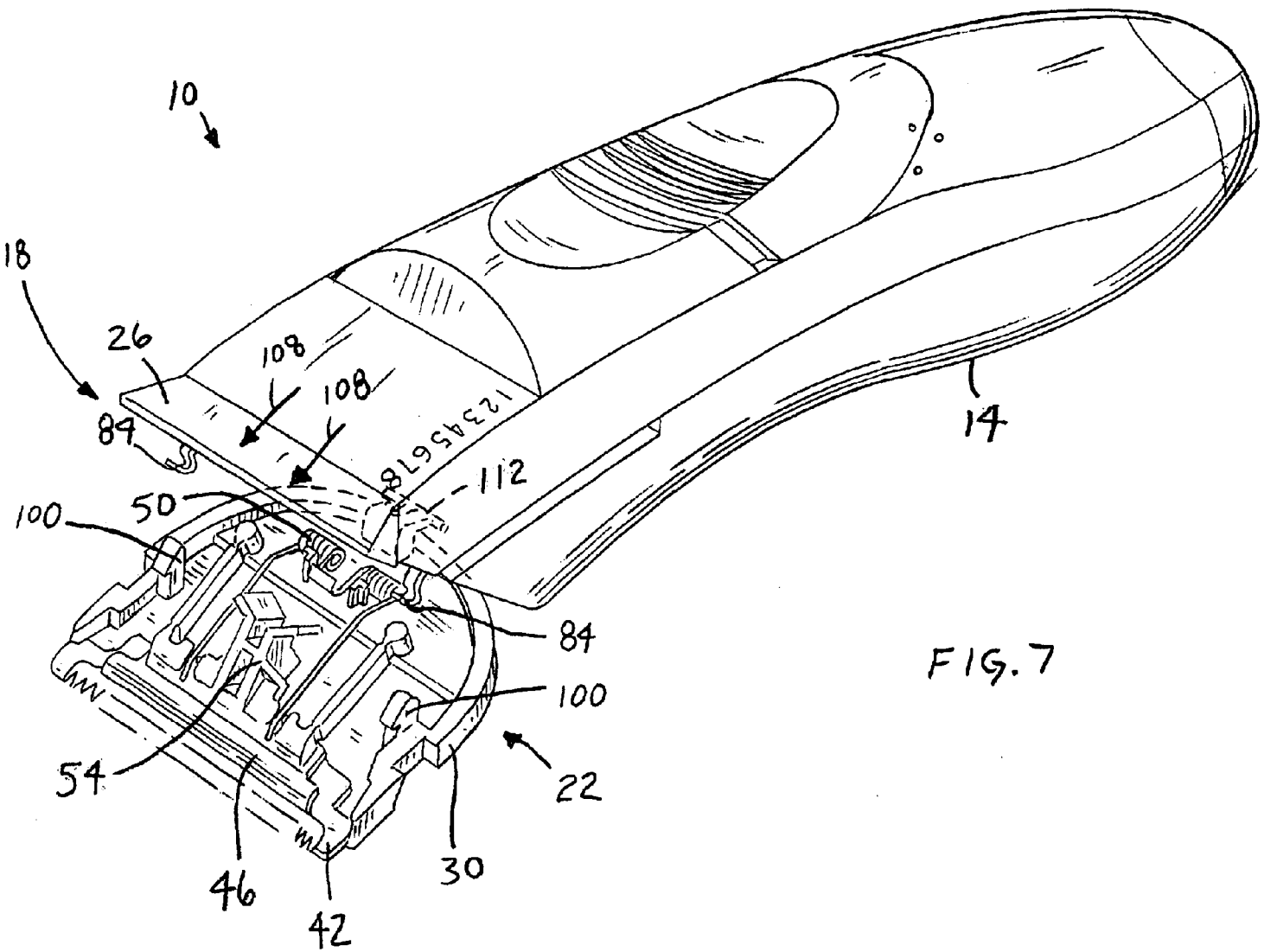
FIG. 7 is a view similar to FIG. 1 illustrating a cutting head of the hair trimmer in an open position.

The drawings illustrate a hair trimmer or clipper 10 according to the present invention including a hollow, elongated body 14 which, at a cutting end 18 (FIG. 5), supports a cutting head 22 (FIG. 7). As shown in FIGS. 2–4, the body 14 includes a top portion 14*a* and a bottom portion 14*b*. A release button 26 (FIGS. 1, 2, and 7) is slidably mounted to the cutting end 18 of the top portion 14*a* and operable to release the cutting head 22 from an operating position (FIGS. 1 and 5) to an open position (FIG. 7) when actuated by an operator of the hair trimmer 10.

As best shown in FIGS. 2 and 7, the cutting head 22 includes a cutting head body 30, a blade set 34, and a driving arrangement 38. The blade set 34 includes a fixed blade 42 connected to the cutting head body 30, and a movable blade 46 held in face-to-face relation with the fixed blade 42 by a spring 50 of the driving arrangement 38. A reciprocation member 54 of the driving arrangement 38 drivingly connects an electric motor 60 (FIGS. 2 and 4) disposed in the body 14 to the movable blade 46. Accordingly, actuation of the motor 60 results in reciprocation of the movable blade 46 and cutting action thereof with respect to the fixed blade 42. Various suitable motors, driving arrangements, and blade sets can be employed.

As shown in FIG. 2, the release button 26 includes a main portion 64 and a pair of L-shaped protrusions 68 extending downwardly from the main portion 64. The main portion 64 and the L-shaped protrusions 68 cooperate to form grooves which slide over guides 72 (FIGS. 3 and 8) of the top portion 14*a* to slidably mount the release button 26 to the top portion 14*a*. As best shown in FIG. 7, the release button 26 cooperates with the cutting end 18 of the top and bottom portions 14*a* and 14*b* to provide a continuous surface for support of the cutting head 22 when the cutting head 22 is in the operating position and the release button 26 is in a retracted position.

Figure 6:
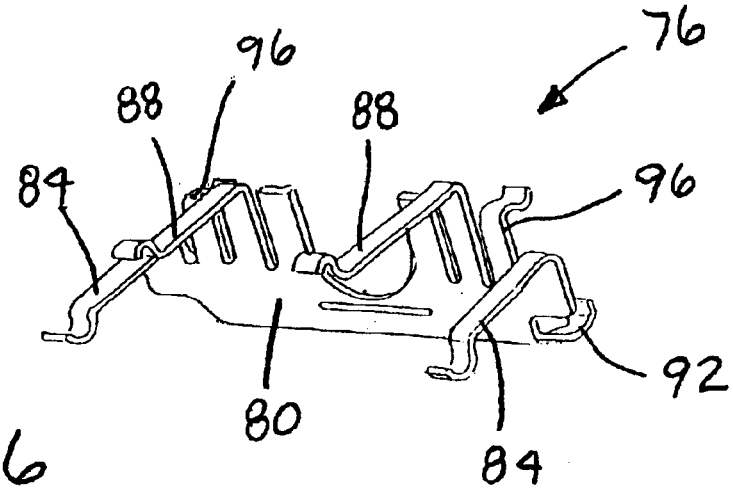
FIG. 6 is a perspective view of a clip of the hair trimmer shown in FIG. 1.

A clip 76 (FIG. 6), coupled to the cutting end 18 of the hair trimmer 10, retains the cutting head 22 in the operating position, releases the cutting head 22 to the open position in response to actuation of the release button 26, biases the release button 26 to the retracted position (FIG. 7), and holds the cutting end 18 of the top and bottom portions 14*a* and 14*b* together.

The clip 76 includes a main portion 80 shaped to conform to the cutting end of the body 14, a first set of prongs 84 extending forwardly from the main portion 80, a second set of prongs 88 extending forwardly from the main portion 80, a third set of prongs 92 extending rearwardly from the main portion 80, and a fourth set of prongs 96 extending rearwardly from the main portion 80. The clip 76 may be alternatively constructed in other embodiments. The first set of prongs 84 retains the cutting head 22 in the operating position, the second set of prongs 88 biases the release button 26 to the retracted position, the third set of prongs 92 are secured to the cutting end 18 of the bottom portion 14*b*, and the fourth set of prongs 96 are secured to the cutting end 18 of the top portion 14*a*.

Figure 5:
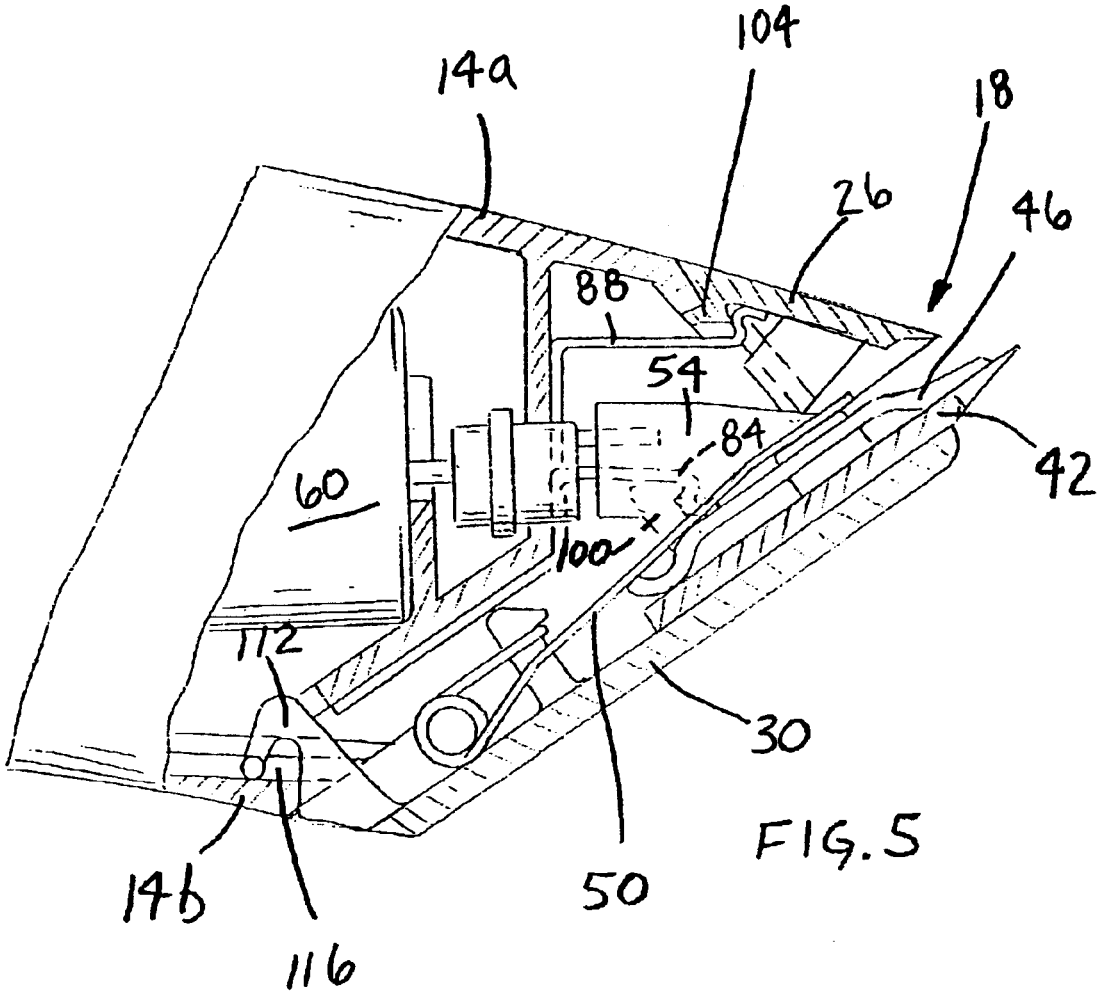
FIG. 5 is a fragmentary sectional view taken along 5—5 of FIG. 1.

The first set of prongs 84 function as cantilever springs to retain the cutting head 22 in the operating position. As illustrated in FIG. 5, the prongs 84 detently engage a pair of protrusions 100 (FIGS. 5 and 7) extending from the cutting head body 30. The retention force provided by the engagement between the prongs 84 and the protrusions 100 is sufficient to overcome incidental contact the cutting head 22 might encounter during operation of the hair trimmer 10.

The second set of prongs 88 function as cantilever springs to bias the release button 26 to the retracted position. As illustrated in FIG. 5, the prongs 88 detently engage a pair of protrusions 104 extending downwardly from the release button 26. The retention force provided by the engagement between the prongs 88 and the protrusions 104 is sufficient to overcome incidental contact with the release button 26 that might occur during operation of the hair trimmer 10. Without the biasing force provided by the second set of prongs 88, the release button 26 could be slidably moved off the top portion 14*a* when the cutting head 22 is in the open position. Biasing the release button 26 ensures its placement for repetitive use.

When the operator of the hair trimmer 10 wishes to move the cutting head 22 from the operating position to the open position, the operator actuates the release button 26 by applying a force in the direction of arrows 108 (FIG. 7). The force slidably moves the release button along the guides 72 of the top portion 14*a* toward the cutting head 22. The release button 26 moves in opposition to the retention force provided by the second set of prongs 88 such that the release button 26 pushes against the cutting head 22 and moves it away from the operating position. Such movement releases the cutting head 22 from the first set of prongs 84 and allows the cutting head 22 to move to the open position. After actuation of the release button 26, the second set of prongs 88 returns the release button 26 to the retracted position. During movement of the release button 26, the second set of prongs 88 remain engaged with the pair of protrusions 104, such that the second set of prongs 88 supply a constant force on the release button 26 that a user must overcome to push the protrusions 100 of the cutting head 22 out of engagement with the first set of prongs 84 and allow the cutting head 22 to move to the open position.

Alternatively, the operator could apply a force directly to the cutting head 22 to overcome the retention force supplied by the first set of prongs 84 and move the cutting head 22 away from the operating position. To return the cutting head 22 to the operating position, the cutting head 22 is moved toward the operating position until the first set of prongs 84 detently engages the protrusions 100.

The cutting head body 30 includes an integrally formed pivoting member 112 (FIGS. 2, 5, and 7) that cooperates with a pivoting channel 116 (FIG. 8) on the bottom portion 14*b* to allow the cutting head 22 to pivot between the operating position and the open position. In other embodiments, the open position may be alternatively located and transitioned to.

Figure 8:
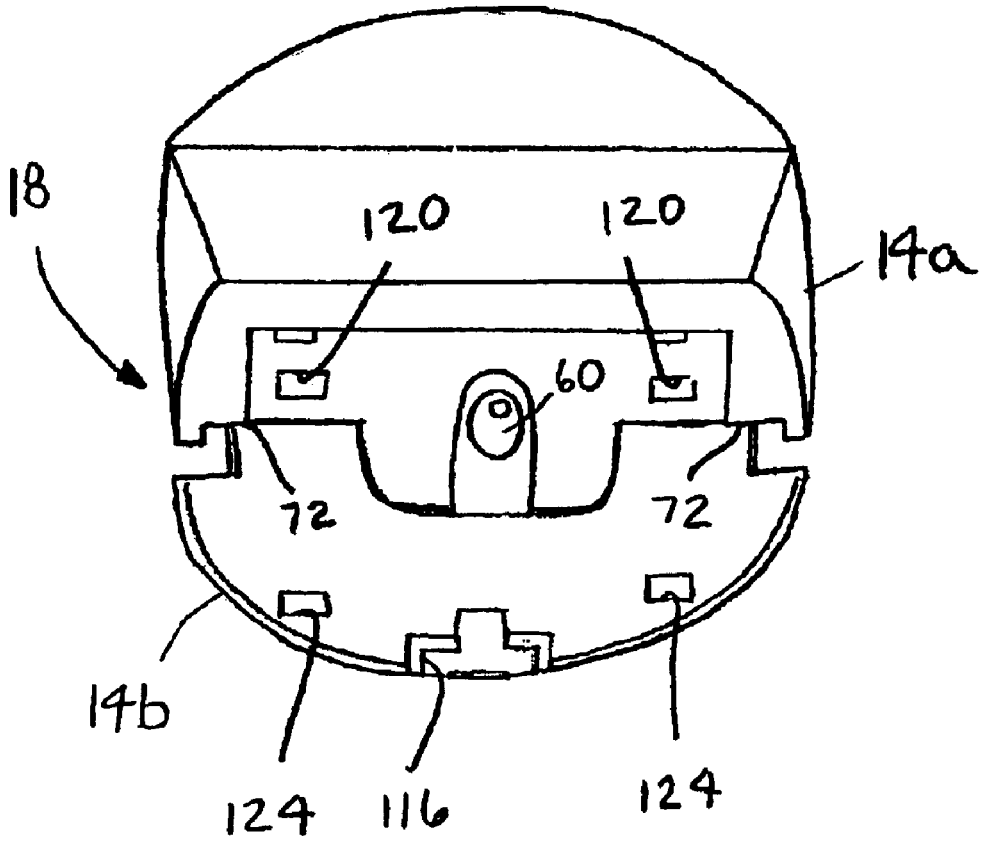
FIG. 8 is a front view of the hair trimmer shown in FIG. 1 with a release button and the clip shown in FIG. 6 removed.

Referring to FIG. 8, the cutting end 18 of the top portion 14*a* includes a pair of top connector apertures 120, and the cutting end 18 of the bottom portion 14*b* includes a pair of bottom connector apertures 124. The third set of prongs 92 of the clip 76 function as clasps which hookably engage the bottom connector apertures 124. The fourth set of prongs 96 function as cantilever springs which secure the cutting end 18 of the top portion 14*a* to the cutting end 18 of the bottom portion 14*b* by engaging the top connector apertures 120. With the third set of prongs 92 already hooked into the bottom connector apertures 124, the fourth set of prongs 96 are moved into the top connector apertures 120. As the fourth set of prongs 96 are moved into the top connector apertures 120, the fourth set of prongs 96 slide up and over bottom edges of the top connector apertures 120. Once in the top connector apertures 120, the fourth set of prongs 96 provide a spring force clamping the top portion 14*a* to the bottom portion 14*b*. Once both the third and fourth sets of prongs 92 and 96 are cooperating with the bottom and top connector apertures 124 and 120, respectively, the cutting end 18 of the body 14 is secured for operation. The opposite end of the body 14 may be held together by placement of a fastener 130 (FIG. 2) through a fastener aperture 132 (FIG. 4) in the bottom portion 14*b* and into a boss 134 (FIGS. 2 and 3) located on the top portion 14*a*.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims.

What is claimed is:

1. A hair trimmer having a release button, the hair trimmer comprising:

a body having a top portion, a bottom portion, and a cutting end;

a cutting head having a fixed blade and a movable blade, the cutting head being pivotably connected to the bottom portion of the body at the cutting end, the release button being movably attached to the top portion of the body at the cutting end and configured to release the cutting head from an operating position to an open position when actuated by an operator of the hair trimmer; and a clip connected to the body and including a first portion configured to bias the release button to a retracted position which permits the cutting head to be positioned in the operating position.

2. A hair trimmer according to claim 1 wherein the top portion of the body is separable from the bottom portion of the body, wherein the clip includes a second portion connected to the top portion of the body and a third portion connected to the bottom portion of the body, and wherein the second and third portions of the clip are configured to secure the top portion of the body to the bottom portion of the body for operation of the hair trimmer.

3. A hair trimmer according to claim 2 wherein the clip includes a main portion that conforms to a portion of the cutting end of the body, and wherein the first, second, and third portions of the clip extend from the main portion of the clip.

4. A hair trimmer according to claim 2 wherein one of the second and third portions of the clip includes at least one clasp and the other of the second and third portions of the clip includes at least one cantilever spring.

5. A hair trimmer according to claim 1 wherein the first portion of the clip includes at least one cantilever spring.

6. A hair trimmer according to claim 5 wherein the release button includes a protrusion, and wherein the cantilever spring engages the protrusion to bias the release button to the retracted position.

7. A hair trimmer according to claim 1 wherein the cutting head includes a cutting head body, and wherein the cutting head body abuts a portion of the release button and a portion of the body when the cutting head is in the operating position.

8. A hair trimmer according to claim 1 wherein the clip includes a second portion configured to selectively retain the cutting head in the operating position, and wherein the second portion releases the cutting head from the operating position to the open position when the release button is actuated by an operator of the hair trimmer.

9. A hair trimmer according to claim 8 wherein the second portion of the clip includes at least one cantilever spring.

10. A hair trimmer according to claim 9 wherein the cutting head includes a protrusion, and wherein the cantilever spring engages the protrusion to selectively retain the cutting head in the operating position.

11. A hair trimmer according to claim 1 wherein the clip is also configured to selectively retain the cutting head in the operating position and hold the top and bottom portions of the body together for operation of the hair trimmer.

12. A hair trimmer according to claim 11 wherein the clip includes a main portion, a first set of forwardly extending prongs, and a second set of forwardly extending prongs, wherein the first portion of the clip includes the first set of forwardly extending prongs, and wherein the second set of forwardly extending prongs selectively retains the cutting head in the operating position.

13. A hair trimmer according to claim 12 wherein each of the first and second sets of forwardly extending prongs includes a pair of cantilever springs.

14. A hair trimmer according to claim 11 wherein the clip includes a main portion, a first set of rearwardly extending prongs, and a second set of rearwardly extending prongs, wherein the first and second sets of rearwardly extending prongs cooperate to hold the top and bottom portions of the body together for operation of the hair trimmer.

15. A hair trimmer according to claim 14 wherein the main portion conforms to a portion of the cutting end of the body.

16. A hair trimmer according to claim 14 wherein one of the first and second sets of rearwardly extending prongs includes a pair of cantilever springs.

17. A hair trimmer according to claim 1 wherein the release button is slidably mounted on the top portion of the body at the cutting end.

18. A hair trimmer according to claim 1 wherein the top portion of the body includes at least one top connector aperture, wherein the bottom portion of the body includes at least one bottom connector aperture, and wherein the clip is connected to the top and bottom connector apertures.

19. A hair trimmer having a release button, the hair trimmer comprising:

a body having a top portion and a bottom portion that is separable from the top portion, the body defining a cutting end;

a cutting head having a cutting head body and a blade set connected to the cutting head body, the cutting head being pivotably connected to the bottom portion of the body at the cutting end, the release button being slidably mounted to the top portion of the body at the cutting end and configured to release the cutting head from an operating position to an open position when actuated by an operator of the hair trimmer, the cutting head body abutting a portion of the release button and a portion of the body when the cutting head is in the operating position; and a clip connected to the body, the clip including a main portion, a first portion extending from the main portion and configured to selectively retain the cutting head in the operating position and release the cutting head from the operating position to the open position when the release button is actuated by an operator of the hair trimmer, a second portion extending from the main portion and configured to bias the release button to a retracted position, the release button permitting the cutting head to be positioned in the operating position when retracted, a third portion extending from the main portion and configured to engage the bottom portion of the body at the cutting end, and a fourth portion extending from the main portion and configured to engage the top portion of the body at the cutting end and cooperate with the third portion to clamp the top and bottom portions of the body together for operation of the hair trimmer.

20. A hair trimmer having a release button, the hair trimmer comprising:

a body having a top portion and a bottom portion that is separable from the top portion, the body defining a cutting end;

a cutting head having a cutting head body and a blade set connected to the cutting head body, the cutting head being pivotably connected to the bottom portion of the body at the cutting end, the release button being slidably mounted to the top portion of the body at the cutting end and configured to release the cutting head from an operating position to an open position when actuated by an operator of the hair trimmer, the cutting head body abutting a portion of the release button and a portion of the body when the cutting head is in the operating position; and a clip connected to the body, the clip including a main portion that conforms to a portion of the cutting end of the body, a first set of prongs extending forwardly from the main portion and configured to bias the release button to a retracted position, the release button permitting the cutting head to be positioned in the operating position when retracted, a second set of prongs extending forwardly from the main portion and configured to selectively retain the cutting head in the operating position, the second set of prongs releasing the cutting head to the open position when the release button is actuated by an operator of the hair trimmer, a third set of prongs extending rearwardly from the main portion and configured to engage the bottom portion of the body at the cutting end, and a fourth set of prongs extending rearwardly from the main portion and configured to engage the top portion of the body at the cutting end and cooperate with the third set of prongs to clamp the top and bottom portions of the body together for operation of the hair trimmer.

* * * * *